US005816850A

United States Patent [19]

Yamada et al.

[11] Patent Number: 5,816,850

[45] Date of Patent: Oct. 6, 1998

[54] ELECTRICAL JUNCTION BOX WITH A FUSE

[75] Inventors: Satoshi Yamada; Hisaharu Kato; Takeyuki Hamaguchi, all of Shizuoka, Japan

[73] Assignee: Yazaki Corporation, Tokyo, Japan

[21] Appl. No.: 677,643

[22] Filed: Jul. 8, 1996

[30] Foreign Application Priority Data

Jul. 6, 1995 [JP] Japan ..... 7-170954

[51] Int. Cl.[6] ..... H01R 31/08

[52] U.S. Cl. ..... 439/507; 439/621

[58] Field of Search ..... 439/507, 511, 439/621, 830, 698, 271, 277

[56] References Cited

U.S. PATENT DOCUMENTS

| | | | |
|---|---|---|---|
| 945,017 | 1/1910 | Cole | 439/830 |
| 1,819,302 | 8/1931 | Rah | 439/750 |
| 2,085,707 | 3/1937 | Shore | 439/830 |
| 4,990,888 | 2/1991 | Vogt et al. | 439/387 |
| 5,150,094 | 9/1992 | Babimi | 439/621 |
| 5,324,207 | 6/1994 | Itoh et al. | 439/271 |
| 5,562,490 | 10/1996 | Rybolt et al. | 439/507 |

*Primary Examiner*—Neil Abrams
*Assistant Examiner*—Christopher Goins
*Attorney, Agent, or Firm*—Sughrue, Mion, Zinn, Macpeak & Seas, PLLC

[57] ABSTRACT

In an electrical junction box with a fuse, a safety plug including a plug body which is moved vertically to electrically connect two terminals to each other and disconnect them from each other, at least one pair of electric wires, and a fuse are fixedly mounted in a frame, the electric wire is connected directly or indirectly to one of the terminal, the terminal is connected directly or indirectly to one end of the fuse, the other end of the fuse is connected directly or indirectly to the electric wire, the plug body is protruded outside from the frame, and a sealing member sealingly closes the gap between the plug body and the frame.

7 Claims, 7 Drawing Sheets

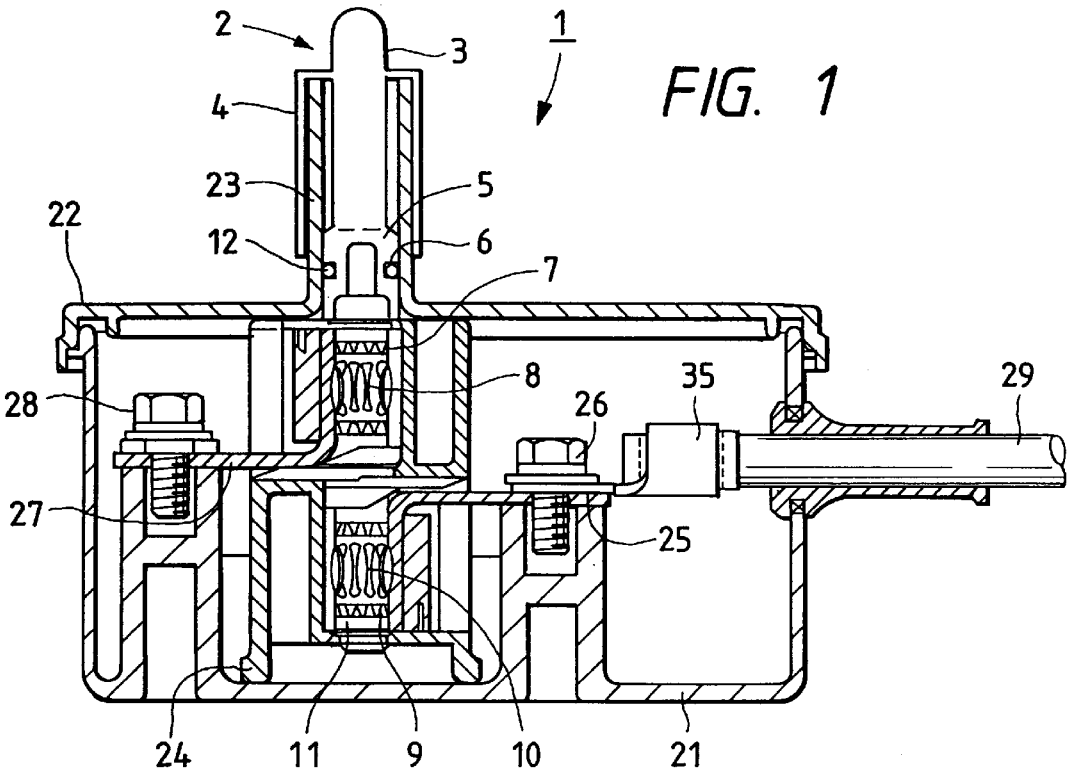
FIG. 1
FIG. 2
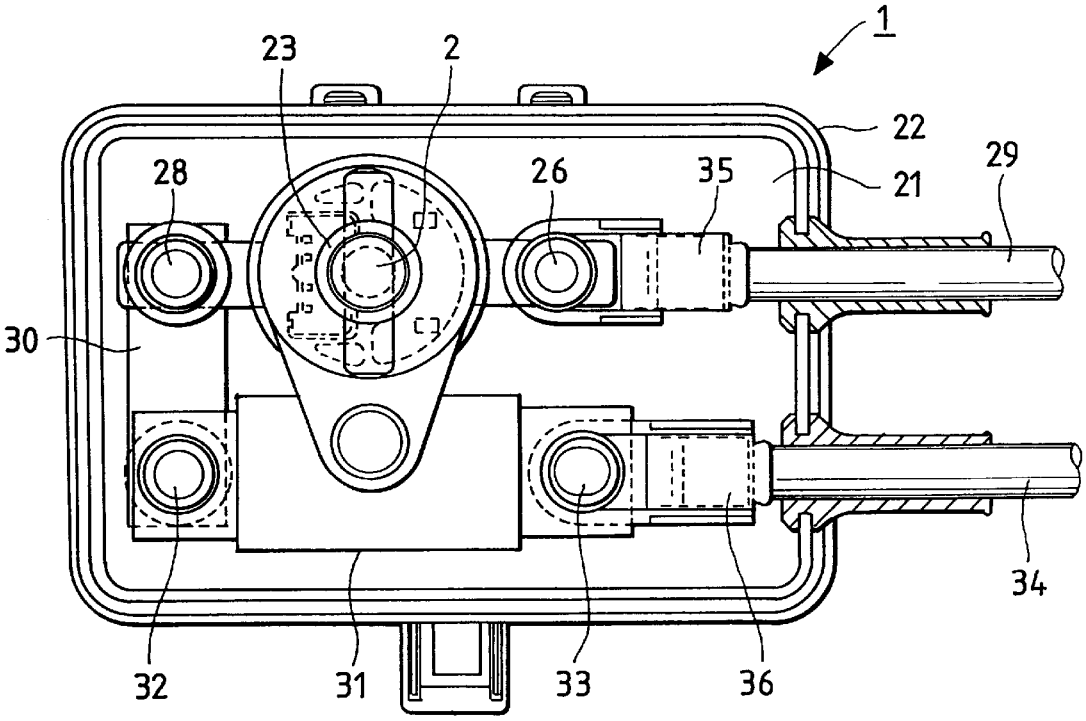

ELECTRICAL JUNCTION BOX WITH A FUSE

BACKGROUND OF THE INVENTION

1. Field of the Industrial Application

This invention relates to electrical junction boxes with a fuse, and more particularly to an electrical junction box with a fuse which is used for opening and closing a high voltage circuit and a large current circuit forming a wire harness in transporting equipment such as motor vehicles including electric motor vehicles.

2. Related Art

Heretofore, for instance a switch board for a high voltage circuit is designed as follows: That is, when the cover of the switch board is opened, a male connector secured to the cover is disengaged from a female connector mounted on the body of the switch board to open the high voltage circuit, thereby to prevent the operator from touching the electrode to get an electric shock.

On the other hand, an electric motor vehicle has a high voltage section for driving the motor. Hence, in the maintenance or repair of an electric motor vehicle, it is essential to see it that the worker may not get an electric shock. Especially, maintenance of repair of a motor car is carried out not only by a skilled person but also by an unskilled person, and therefore it should be provided with means for positively preventing the worker from getting an electric shock.

For this purpose, a conventional electric motor vehicle has an electrical junction box with a safety plug for shutting off the high voltage circuit. Before servicing the vehicle, for instance, by inspecting or replacing the fuse or by, the safety plug in the electrical junction box is operated to allow the worker to serve the vehicle in safety.

The above-described conventional electrical junction box with a fuse (hereinafter referred to merely as "an electrical junction box", when applicable) is as shown in FIGS. 17 and 18.

As shown in those figures, the electrical junction box 101 has a rectangular-box-shaped casing 102. In the casing 102, the following components are provided: a terminal 112 whose rear end is connected to an electric wire 113, a safety plug 110, a cylindrical fuse 111 having connecting pieces extended from its both ends, and a terminal 117 whose rear end is connected to another electric wire 118. The casing 102 is opened upwardly, and has a sealing member (or O-ring) 104 fitted in an annular groove formed in the casing 102 along the upper edge.

A cover 103 is placed on the upper edge of the casing 102. When the casing 102 is closed with the cover 103, the inner surface of the cover 103 is brought into close contact with the O-ring 104; that is, the junction box 101 is of water tight type.

The safety plug 110 comprises: a conductive connecting pin which is vertically movable; two elongated multi-springs mounted on the pin in such a manner that they are arranged axially spaced from each other; and two female type terminals which are arranged vertically so as to receive the connecting pin. When the connecting pin is at the lower position, being pushed downwardly, the two multi-springs are brought into contact with the two female type terminals, respectively, so that the latter (terminals) are electrically connected to each other; whereas when the connecting pin is at the upper position, being pulled upwardly, at least one of the two multi-springs is not in contact with the respective female type terminal, so that the two female terminals are electrically disconnected from each other.

Inside the casing 102, the terminal 112, and one of the two female type terminals of the safety plug 110 are threadably connected to the casing 102 with a bolt 114, so that the terminal 112 and the one female type terminals are electrically connected to each other, and secured to the casing. The electric wire 113 connected to the rear end of the terminal 112 is extended outside the casing 102 through a sealing member such as a grommet.

The other female terminal of the safety plug 110, and the connecting piece extended from one end of the fuse 111 are threadably fixed to the casing 102 with a bolt 115, so that the other female terminal of the safety plug 110, and the fuse 111 are electrically connected to each other and fixedly secured to the casing 102.

The connecting piece extended from the other end of the fuse 111, and the terminal 117 are threadably fastened to the casing 102 with a bolt 116, so that the terminal 117 and the fuse 111 are electrically connected to each other, and fixedly secured to the casing 102. The electric wire 118 connected to the rear end of the terminal 117 is extended outside the casing 102 through a sealing member such as a grommet.

When, in the electrical junction box 101 thus constructed, the safety plug 110 is pulled up, the two terminals 112 and 117 are electrically disconnected from each other; and when the safety plug 110 is pushed down, those terminals 112 and 117 are electrically connected to each other.

In the above-described conventional electrical junction box, for the purpose of making the electrical junction box water-tight, the essential elements thereof are set inside the casing 102 closed with the cover 103. Hence, whenever it is required to operate the safety plug 110, it is necessary to remove the cover 103 to open the casing 102. This is rather troublesome.

On the other hand, as was described above, the O-ring 104 is put on the casing 102 along the upper edge for the purpose of making the electrical junction box water-tight. Hence, the contact area of the O-ring and the cover is relatively large, providing a relatively great frictional force. Therefore, it requires a great force to engage the cover with the casing or to disengage the former from the latter. That is, the conventional electrical junction box is low in operational efficiency. Furthermore, the O-ring is large in size, and therefore the use of the O-ring is undesirable from the view point of manufacturing cost.

Moreover, the number of components is large, and therefore it is difficult to miniaturize the electrical junction box and to reduce the manufacturing cost.

In addition, as is seen from FIGS. 17 and 18, all the components between the electric wires 113 and 118 are arranged in one line, and therefore the casing 102 is unavoidably large in horizontal dimension. This is another problem to be solved.

SUMMARY OF THE INVENTION

Accordingly, an object of the invention is to solve the above-described problems accompanying a conventional electrical junction box with a fuse. More specifically, an object of the invention is to provide an electrical junction box with a fuse which, when compared with the conventional one, is small in the number of components, small in size, and low in manufacturing cost, and can be serviced readily.

The foregoing object of the invention has been achieved by the provision of the following means:

The first means is an electrical junction box with a fuse in which, according to a first aspect of the invention, a safety plug including a plug body which is moved vertically to electrically connect two terminals to each other and disconnect the two terminals from each other, a least one pair of electric wires, and a fuse are fixedly mounted in a frame, one of the pair of electric wires is connected directly or indirectly to one of the terminals, the other terminal is connected directly or indirectly to one end of the fuse, the other end of the fuse is connected directly or indirectly to the other electric wire, the plug body is protruded outside from the frame, and a sealing member sealingly closes the gap between the plug body and the frame.

In the electrical junction box as claimed in claim 1, a circuit formed by arranging the one electric wire, the two terminals of the safety, the fuse and the other electric wire in the stated order is substantially U-shaped.

The second means is an electrical junction box with a fuse which, according to a second aspect of the invention, comprises:

an electrical junction box body which is hollow and elongated, and which has first and second housings respectively at both ends thereof as viewed in the direction of longitudinal axis thereof, and an opening section formed on its one side wall in such a manner that the opening section is perpendicular to the direction of longitudinal axis;

a cover which is engaged with the opening section, being movable in a direction perpendicular to the direction of longitudinal direction of the electrical junction box body;

a fuse which is held in the cover and has connecting pieces extended from both ends of the fuse, the fuse being moved together with the cover;

a first terminal secured to the first housing, the first terminal having the rear end which is connected to a first electric wire, and the front end which is engaged with the connecting piece extended from one of the both ends of the fuse;

a second terminal secured to the second housing, the second terminal having the rear end which is connected to a second electric wire, and the front end which is engaged with the connecting piece extended from the other end of the fuse; and a sealing member which sealingly closes the gap between the outer wall of the cover and the inner surface of the electrical junction box cover.

In the electrical junction box according to the first aspect of the invention, the circuit is opened and closed merely by sliding the plug body up and down which is protruded outside from the frame. Hence, the electrical junction box of the invention is free from the troublesome work that the frame is opened whenever it is required to open and close the circuit. Thus, with the electrical junction box, the maintenance and repair of the circuit can be achieved with ease.

In the electrical junction box, the sealing member which sealingly closes the gap between the plug body and the frame is short in circumference. This feature makes it possible to readily slide the plug body up and down, and contributes to the improvement in water-tightness of the electrical junction box. Furthermore, the components forming the circuit are so arranged that the circuit is substantially U-shaped.

The electrical junction box according to the second aspect of the invention operates as follows: When the cover is pushed inwardly, towards the electrical junction box body, the connecting pieces extended from both ends of the fuse are engaged with both the terminal secured to the first housing and the terminal secured to the second housing, respectively, so that the two terminals are electrically connected to each other through the fuse. When, on the other hand, the cover is pulled outwardly, the connecting pieces of the fuse are disengaged from the terminals which are secured to the first and second housings, respectively, so that those two terminals are electrically disconnected from each other. The sealing member which sealingly closes the gap between the cover and the electrical junction box body is small in contact area. Hence, the two terminals can be electrically connected to or disconnected from each other with ease, and the electrical junction box is improved in water-tightness.

BRIEF DESCRIPTION OF THE DRAWINGS

FIG. 1 is a sectional view of an example of an electrical junction box with a fuse, which constitutes a first embodiment of the invention;

FIG. 2 is a top view, with parts cut away, of the electrical junction box shown in. FIG. 1;

DETAILED DESCRIPTION OF THE PREFERRED EMBODIMENTS

FIRST EMBODIMENT

An example of an electrical junction box with a fuse (hereinafter referred to merely as "an electrical junction box", when applicable), which constitutes a first embodiment of the invention, will be described with reference to FIGS. 1 through 3.

Figure 3:
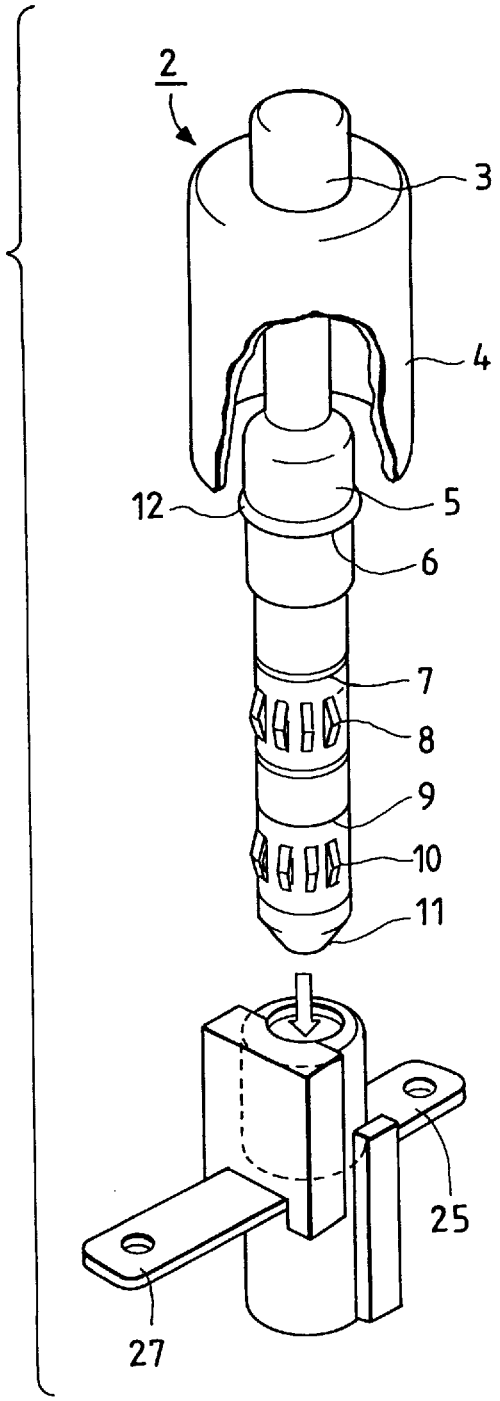
FIG. 3 is an exploded perspective view of a safety plug in the electrical junction box shown in FIG. 1.

FIG. 1 is a sectional view showing the arrangement of the electrical junction box, which is the first embodiment of the invention, FIG. 2 is a top view, with parts cut away, of the electrical junction box, and FIG. 3 is an exploded perspective view of a safety plug in the electrical junction box.

As shown in those figures, reference numeral 1 designates the electrical junction box. The latter 1 comprises: a rectangular-box-shaped insulating casing 21, which accommodates a first terminal 35 whose rear end is connected to an electrical wire 29, a safety plug 2, a fuse 31, a bus bar 30, and a second terminal 36 whose rear end is connected to an electrical wire 34. The casing 21 is opened upwardly, and it is closed with a box cover 22.

The box cover 22 is integral with a cylindrical hood 23 which is extended outwardly from the former 22. That is, the hood 23 is in the form of a hollow pipe, and its upper end is opened outside, and its lower end is opened in the casing 21. Thus, the casing 21 and the box cover 22 form a frame.

The safety plug 2 is elongated, comprising a plug body 3. In the plug body 3, its front portion (the lower end portion in FIG. 1) is a cylindrical conductive pin section 11, and the middle portion is a cylindrical slide section 5, and the rear end portion (the upper end portion in FIG. 1) is an insulating cylinder. The plug body 3 has a cylindrical insulating skirt 4 outside the upper end portion in such a manner that the former 4 is coaxial with the latter (the upper end portion). The safety plug 2 further comprises: a first terminal member 25, and a second terminal member 27 which is provided above the former 25. The first and second terminal members 25 and 27 are accommodated in a housing 24 mounted in the casing. At least the rear end portion (the upper end portion in FIG. 1) of the plug body 3 is protruded outside from the box cover 22.

In the outer cylindrical surface of the pin section 11 of the plug body 3, first and second annular recesses (or relatively wide grooves) are formed in such a manner that they are spaced axially from each other. A first multi-spring 8 is fitted in the first annular recess 7, and a second multi-spring 10 is fitted in the second annular recess 9.

An annular groove 6 is formed in the outer cylindrical surface of the slide section 5, and an O-ring 12 is fitted in the annular groove 6 thus formed.

The plug body 3 is inserted into the cylindrical hood 23 of the box cover 22 from above. The plug body 3 thus inserted is vertically movable along the hood 23 with the slide section 5 being in slide contact with the inner cylindrical surface of the hood 23.

When the plug body 3 is inserted into the cylindrical hood 33 in the above-described manner, the O-ring (or sealing member) 12 sealingly closes the gap between the slide section 5 and the inner cylindrical surface of the hood 23 at all times. Thus, the combination of the plug body 3 and the hood 23 is of water-tight type.

The first and second terminal members 25 and 27 are so designed that the pin section 11 can be inserted into them. When the pin section 11 is at the lower position being pushed downwardly, the first multi-spring 8 and the second multi-spring 10 are brought into contact with the first terminal member 25 and the second terminal member 27, respectively, so that the first terminal member 25 is electrically connected through the electrically conductive pin section 11 to the second terminal member 27.

When the pin section 11 is at the upper position being pulled upwardly, at least one of the first and second multi-springs 8 and 10 is left from the first or second terminal members 25 or 27, so that those terminal members 25 and 27 are electrically disconnected from each other.

Inside the casing 21, the first terminal 35, and the first terminal 25 of the safety plug 2 are fastened to the casing 21 with a bolt 26, so that the first terminal 35 and the first terminal member 25 are held electrically connected to each other, and fixedly secured to the casing 21. The electric wire 29 connected to the rear end of the first terminal 35 is extended outside the casing through a sealing member such as a grommet.

The second terminal member 27 of the safety plug 2 and one end portion of a bus bar 30 are fastened to the casing 21 with a bolt 28, so that the second terminal member 27 and the bus bar 30 are electrically connected to each other and fixedly secured to the casing 21.

The other end portion of the bus bar 30 and one end of the fuse 31 are fastened to the casing 21 with a bolt 32, so that the bus bar 30 and the fuse 31 are electrically connected, and the other end of the bus bar 30 and the one end of the fuse are 31 are fixedly secured to the casing 21.

The electric wire 34 connected to the rear end of the second terminal 36 is extended outside the casing 21 through a sealing member such as a grommet.

In the electrical junction box designed as described above, the plug body is protruded from the box cover 22. Hence, the operator is able to open and close the safety plug by moving the plug body 3 up and down without opening the box cover 22.

In this case, the gap between the slide section 5 and the inner cylindrical surface of the hood 23 is maintained sealingly closed by the O-ring (sealing member) 12 as was described above; that is, the electrical junction box is maintained water-tight even when the plug body 3 is moved up and down.

The O-ring 12 is small in diameter, and its slide area is accordingly small. Hence, it is unnecessary to use a great force to move the plug body 3 up and down; that is, the electrical junction box can be operated readily.

The electrical circuit arrangement in the casing 21 is U-shaped; that is, the components are not arranged in one line, which contributes to the miniaturization of the electrical junction box.

Figure 4:
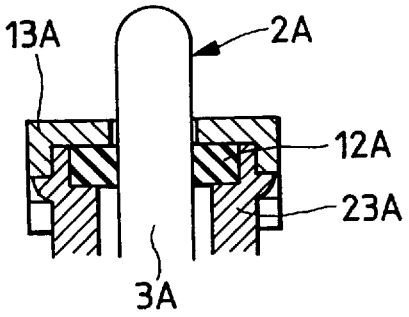
FIG. 4 is a sectional view the arrangement of essential component of one modification of a sealing mechanism in the electrical junction box shown in FIG. 1.

FIG. 4 is a sectional view showing the arrangement of essential parts in one modification of the sealing mechanism in the electrical junction box. In the modification, a rubber plug 12A is fitted in the gap between the outer cylindrical surface of the plug body 3A of a safety plug 2A and the inner cylindrical surface of a hood 23A, to sealingly close the gap between them.

SECOND EMBODIMENT

Figure 5:
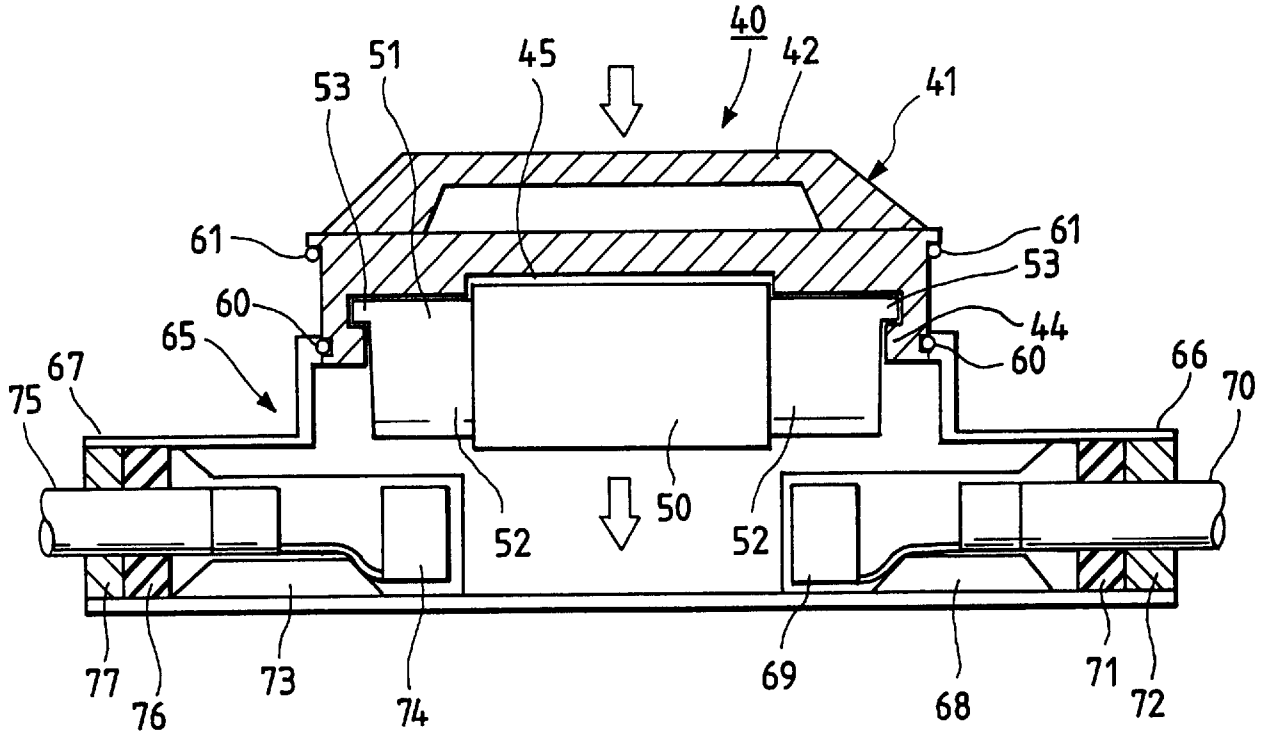
FIG. 5 is a sectional view showing another example of the electrical junction box, which constitutes a second embodiment of the invention.

FIG. 5 is a sectional view showing another example of the electrical junction box, which constitutes a second embodiment of the invention.

In FIG. 5, reference numeral 40 designates the electrical junction box, which constitutes the second embodiment of the invention. The electrical junction box 40 comprises: an electrical junction box body 65 (hereinafter referred to as "a box body 65", when applicable); a cover 41 which is slidably moved along the box body 65; a fuse 50 held by the cover 41; and two terminals 69 and 74 which are engaged with connecting pieces 51 and 51, respectively, which are extended from both ends of the fuse 50.

The electrical junction box body 65 is in the form of a hollow cylinder which has a first housing 66 and a second housing at both ends as viewed in the direction of axis (in the longitudinal direction), and an opening section formed on its side wall in such a manner that the opening section is extended in a direction perpendicular to the longitudinal axis. The aforementioned cover 41 is slid along the opening section.

The cover 41 has a handle 42 on its upper surface, and a recess 45 in the lower surface. The fuse 50 is positioned by the recess. On the other hand, the connecting pieces 51 at both ends of the fuse 50 have engaging ears 53 and 53, respectively. Those ears 53 and 53 are engaged with two grooves which are defined by two protrusions 44 and 44 which are extended downwardly from both end portions of the cover 41, respectively, so that the fuse 50 is held by the cover 41.

A first O-ring 60 fitted on the outer wall of the cover 41 is a sealing member which sealingly closes the gap between the outer wall of the cover 41 and the opening section of the box body 65, to prevent the entrance of rainwater and dust.

Figure 6:
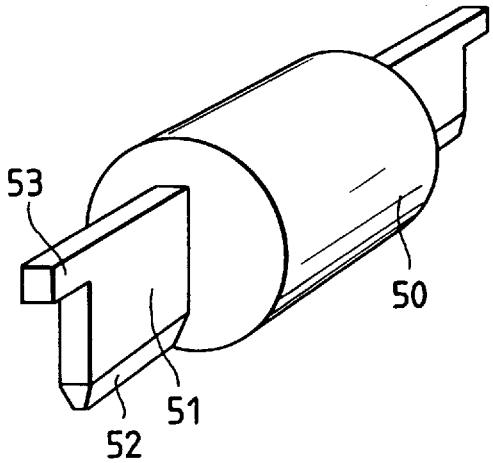
FIG. 6 is a perspective view of a fuse in the electrical junction box shown in FIG. 5.

FIG. 6 is a perspective view of the fuse 50.

In the connecting pieces 51 and 51 extended from both ends of the fuse 50, the lower end portions thereof are formed into blades 52 and 52, respectively, which are tapered downwardly. Those blades 52 are to readily insert the connecting pieces 51 and 51 into the terminals 69 and 74, respectively.

Referring back to FIG. 5, a terminal stopper 68 is provided on the bottom of the first housing 66 as if it were raised from the bottom of the latter 66. The terminal 69 is positioned and fixed by the terminal stopper 68.

An electric wire 70 connected to the rear end of the terminal 69 is extended outside the first housing 66, and the gap between the electrical wire and the first housing is sealingly closed by a rubber plug 71 which is backed up with a rear holder 72.

Figure 7:
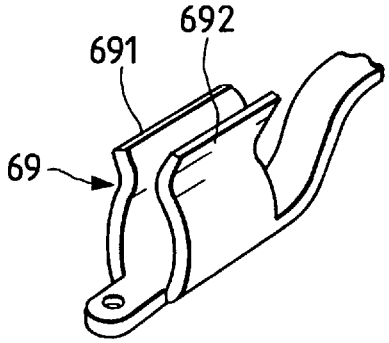
FIG. 7 is a perspective view of a terminal in the electrical junction box shown in FIG. 5.

FIG. 7 is a perspective view showing the terminal 69. The terminal 69 includes a pair of elastic pieces 691 and 692 which are confronted with each other. The connecting piece 51 is inserted into the gap between the elastic pieces 691 and 692, so that the connecting piece 51 and accordingly the fuse is electrically connected to the terminal and accordingly to the electric wire.

Similarly, a terminal stopper 73 is provided on the bottom of the second housing 67 as if it is raised from the bottom of the latter 67. The terminal 74 is positioned and fixed by the terminal stopper 73 thus provided. That is, the front end portion of the terminal is so fixedly positioned as to receive the other connecting piece 51 of the fuse 50.

An electric wire 75 connected to the rear end of the terminal 74 is extended outside the second housing 67, and the gap between the electrical wire and the second housing is sealingly closed by a rubber plug 76 which is backed up with a rear holder 77.

Figure 8:
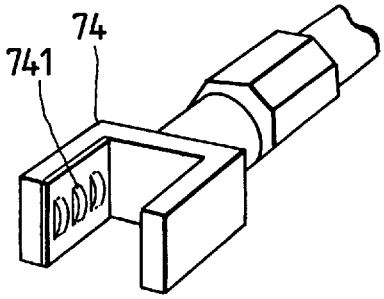
FIG. 8 is a perspective view of one modification of the terminal in the electrical junction box shown in FIG. 5.

FIG. 8 is a perspective view showing a modification of the terminal 74. The end portion of the terminal is formed into a U-shaped solid frame, and multi-springs 741 are provided on the inner surfaces of the frame, respectively, which are confronted with each other.

Figure 9:
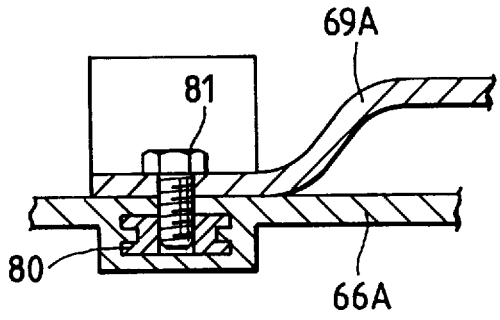
FIG. 9 is a sectional view for a description of a terminal mounting mechanism in the electrical junction box shown in FIG. 5.

FIG. 9 is a sectional view for a description of a terminal mounting mechanism in the electrical junction box. In the mechanism, a terminal 69A has a bolt hole, so that it is threadably engaged with an insert nut 80 buried in the housing 66A, thus being fixedly secured to the latter 66A.

Figure 10:
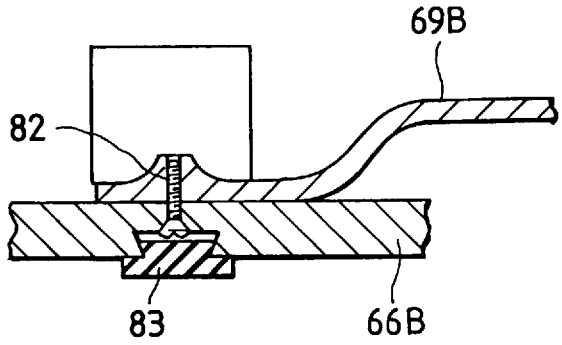
FIG. 10 is a sectional view for a description of one modification of the terminal mounting mechanism in the electrical junction box shown in FIG. 5.

FIG. 10 is a sectional view for a description of one modification of the terminal mounting mechanism. As shown in FIG. 10, a terminal 69B has a threaded hole, and it is threadably fixed to a housing 66B.

Figure 11:
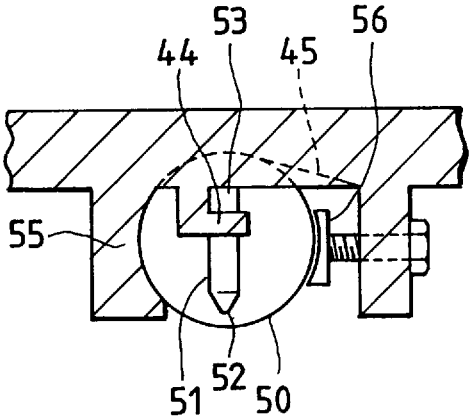
FIG. 11 is a sectional view for a description of a fuse mounting mechanism in the electrical junction box shown in FIG. 5.
Figure 12:
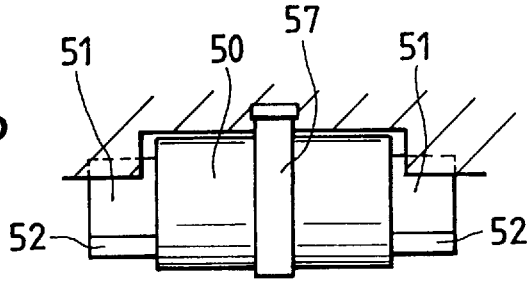
FIG. 12 is a sectional view for a description of one modification of the fuse mounting mechanism in the electrical junction box shown in FIG. 5.

FIG. 11 is a sectional view for a description of the mounting of the fuse 50 in the electrical junction box shown in FIG. 5. As shown in FIG. 11, the fuse 50 is positioned by a stopper 55 formed on the cover 41, and held by a metal holder 56. FIG. 12 shows one modification of the mounting of the fuse 50 in the electrical junction box. In the case of FIG. 12, the fuse 50 is held with a band 57.

Figure 13:
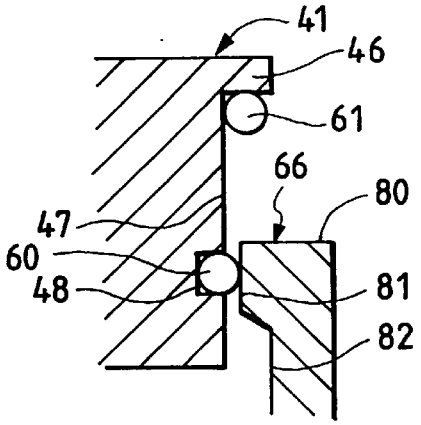
FIGS. 13, 14 and 15 are explanatory diagrams for a description of a sealing mechanism in the electrical junction box shown in FIG. 5.
Figure 14:
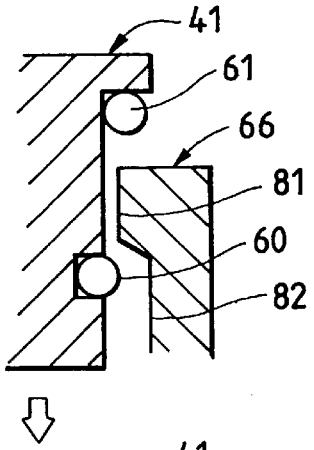
Figure 15:
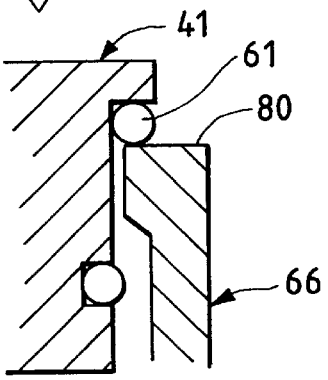

FIGS. 13 through 15 are diagrams for a description of the sealing mechanism of the electrical junction box shown in FIG. 5.

When, as shown in FIG. 13, the cover 41 is at the predetermined upper position (being temporarily locked); that is, the circuit is opened, the first O-ring 60 fitted in a first cylindrical groove 48 formed in the outer wall of the cover 41 is in contact with the side end face of the protrusion of the first housing 66.

When, under this condition, the cover 41 is moved downwardly as shown in FIG. 14, the first O-ring 60 is left from the side end face 81 of the protrusion of the first housing 66. In this case, the first O-ring 60 is not in contact with any surfaces; that is, the movement of the first O-ring 60 is free from frictional resistance, so the cover 41 can be readily moved.

When the cover reaches the predetermined lower position (being finally locked) as shown in FIG. 15, the second O-ring 61 fitted on the outer wall in such a manner that it is located under the upper protrusion 46 of the cover 41, is brought into contact with the upper end face 80 of the protrusion of the first housing, thus sealingly closing the electrical junction box.

In the case where it is possible to obtain a force great enough to move the cover 41 at all times, the electrical junction box may be so modified that the first O-ring 60 is kept in contact with the inner side surface 82 of the first housing 66 not only when the cover is being moved but also it is locked. In this modification, it may be unnecessary to employ the second O-ring 61.

Figure 16:
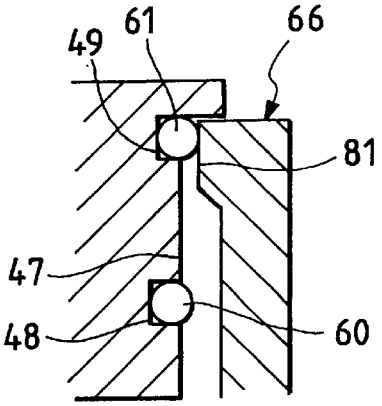
FIG. 16 is an explanatory diagram for a description of one modification of the sealing mechanism in the electrical junction box shown in FIG. 5.
Figure 17:
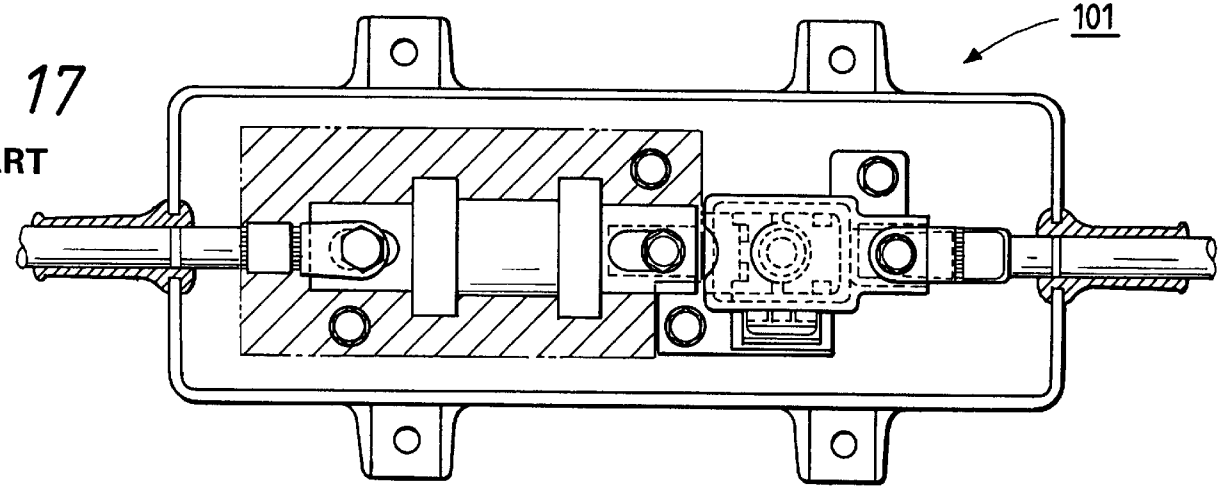
FIG. 17 PRIOR ART
FIG. 17 is a top view showing the arrangement of a conventional electrical junction box with a fuse.
Figure 18:
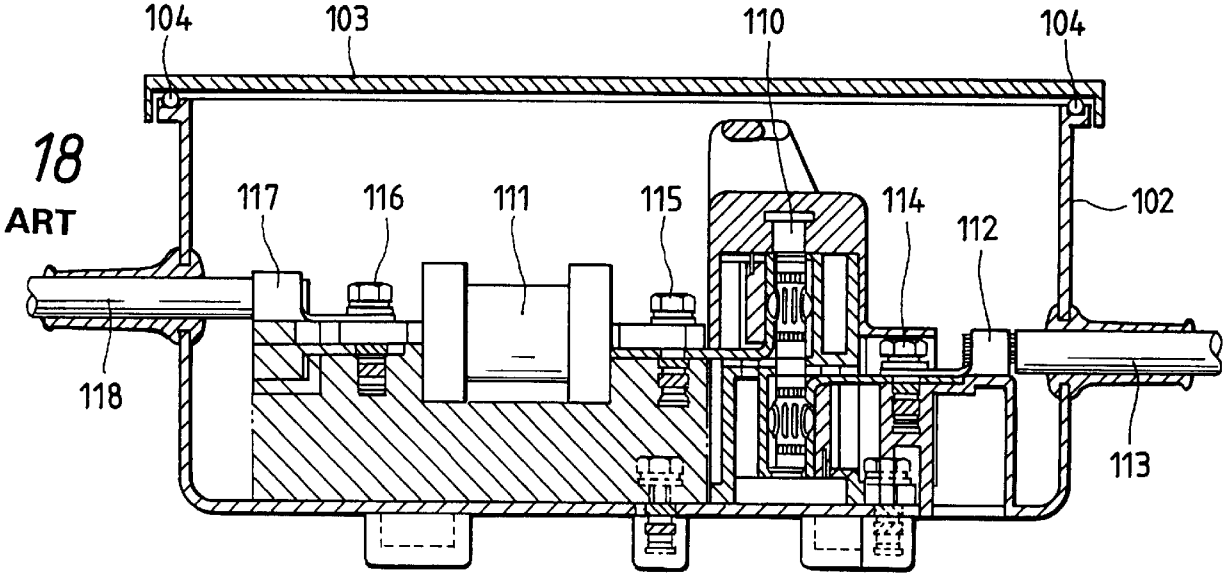
FIG. 18 PRIOR ART
FIG. 18 is a sectional view of the conventional electrical junction box shown in FIG. 17.

Furthermore, the electrical junction box may be modified as shown in FIG. 16. That is, the second O-ring 61 is fitted in a second groove 49 which is formed in the outer wall 47 of the cover 41 in such a manner that it is located under the upper protrusion 46. In this modification, when the cover is temporarily locked, the first O-ring 60 is in contact with the side surface 81 of the protrusion of the first housing 66; and when the cover 41 is finally locked, the second O-ring 60 is in contact with the side surface 81.

The operation of the electrical junction box 40 thus constructed will be described.

When the cover 41 is moved towards the box body 65 (in the direction of the arrow, or downwardly in FIG. 5), the connecting pieces 51 and 51 extended from both ends of the fuse 50 are engaged with the terminal 69 secured to the first house 66 and the terminal 74 secured to the second housing 67, respectively, so that those terminals 69 and 74 are electrically connected with each other through the fuse 50.

When, under this condition, the cover 41 is moved outwardly (upwardly in FIG. 5), the connecting pieces 51 and 51 of the fuse 50 are left from the terminal 69 secured to the first housing 66 and the terminal 74 secured to the second housing 67, respectively, so that those terminals 69 and 74 are electrically disconnected from each other.

As is apparent from the above description, the second embodiment of the invention can be formed without the safety plug which is high in cost and large in size. Hence, the electrical junction box of the invention is reduced in manufacturing cost and in size, when compared with the conventional one.

The sealing member adapted to sealingly close the gap between the cover and the electrical junction box body is small in contact area. Hence, the two terminals can be electrically connected to or disconnected from each other with ease. Thus, the electrical junction box of the invention is high in operational efficiency.

As was described above, in the electrical junction box according to the first aspect of the invention, the circuit is opened and closed merely by sliding the plug body up and down which is protruded outside from the frame. Hence, the electrical junction box of the invention is free from the troublesome operation that the frame is opened whenever it is required to open and close the circuit. Thus, with the electrical junction box, the maintenance and repair of the circuit can be achieved with ease.

In the electrical junction box, the sealing member which sealingly closes the gap between the plug body and the frame is short in circumference. This feature makes it possible to readily slide the plug body up and down, and contributes to the improvement in water-tightness of the electrical junction box. Furthermore, the O-ring is small in size, which is advantageous in the view point of the manufacturing cost, and improves the water-tightness. Furthermore, the circuit consisting of various components is substantially U-shaped, which further reduces the lateral dimension of the electrical junction box.

In the electrical junction box according to the second aspect of the invention, the circuit is opened and closed merely by sliding the cover with respect to the electrical junction box body. Hence, the electrical junction box, unlike the conventional one, is free from the troublesome work that the frame is removed whenever it is required to open and close the circuit; that is, the inspection and maintenance of the circuit can be achieved with ease.

Furthermore, the O-ring which sealingly closes the gap between the cover and the electrical junction box body is small in circumference, and therefore the cover can be slid with ease. This means that the electrical junction box is high in operational efficiency. In addition, the O-ring is small in size. This feature is advantageous in the view point of manufacturing cost, and improves the water-tightness.

On the other hand, the electrical junction box is formed without the expensive safety plug, and is smaller in the number of components including the bolts than the conventional electrical junction box. Hence, the electrical junction box is small in size and low in manufacturing cost.

Moreover, the various components of the circuit are arranged U-shaped, which reduces the lateral dimension of the electrical junction box.

If summarized, the electrical junction box of the invention is improved in water-tightness, and is reduced in the number of components, and accordingly both in size and in manufacturing cost. In addition, the inspection and maintenance of the circuit can be achieved with ease. Those effects should be highly appreciated.

What is claimed is:

1. An electrical junction box comprising:

a safety plug including:

a plug body which is moved vertically to electrically connect two terminals to each other and disconnect said two terminals from each other, said plug body being protruded outside from a frame of said electrical junction box, wherein said frame has a tubular portion for substantially receiving said slug body, at least one pair of electric wires connected to said terminals, respectively;

a fuse fixedly mounted in said frame; and a sealing member sealingly closing the gap between said plug body and said frame, wherein said sealing member fits in a groove formed on said plug body, wherein one of said pair of electric wires is connected to one of said terminals in one of directly or indirectly, the other terminal is connected to one end of said fuse in one of directly and indirectly and the other end of said fuse is connected to the other electric wire in one of directly and indirectly.

2. An electrical junction box as claimed in claim 1, wherein a circuit formed by arranging the one electric wire said two terminals, said fuse, and the other electric wire in the stated order is substantially U-shaped.

3. An electrical junction box comprising:

an electrical junction box body which is hollow and elongated, and which has first and second housings respectively at both ends thereof as viewed in the direction of longitudinal axis thereof, and an opening section formed on one side wall thereof in such a manner that said the axis of said opening section is perpendicular to the direction of longitudinal axis;

a cover engaged with said opening section, said cover being movable in a direction perpendicular to the direction of longitudinal direction of said electrical junction box body;

a fuse which held in said cover, said fuse having connecting pieces extended from both ends thereof, said fuse being moved together with said cover;

a first terminal secured to said first housing, said first terminal having the rear end which is connected to a first electric wire, and the front end which is engaged with said connecting piece extended from one of said both ends of said fuse;

a second terminal secured to said second housing, said second terminal having the rear end which is connected to a second electric wire, and the front end which is engaged with said connecting piece extended from the other end of said fuse; and a sealing member which sealingly closes the gap between the outer wall of said cover and the inner surface of said electrical junction box cover.

4. An electrical junction box as claimed in claim 3, wherein said first terminal and said second terminal have a pair of elastic pieces, respectively.

5. An electrical junction box as claimed in claim 3, wherein said first terminal and said second terminal have multi-springs on inner surfaces of said first terminal and said second terminal respectively.

6. An electrical junction box as claimed in claim 3, further comprising a second sealing member which sealingly closes the gap between the outer wall of said cover and the inner surface of said electrical junction box cover where said first sealing member is positioned in a first groove formed along a lower outer edge of said cover so that said cover may be temporarily locked and said second sealing member is positioned in a second groove formed above said first groove.

7. An electrical junction box as claimed in claim 3, further comprising a handle on a top portion of said cover.

* * * * *